United States Patent [19]

Collier, Jr. et al.

[11] Patent Number: 4,483,255

[45] Date of Patent: Nov. 20, 1984

[54] NIGHT DEPOSITORY

[75] Inventors: William S. Collier, Jr., Land of Lakes; Lucien Carignan, Newport Richey, both of Fla.

[73] Assignee: Collier Safe Co., Inc., Odessa, Fla.

[21] Appl. No.: 430,437

[22] Filed: Sep. 30, 1982

[51] Int. Cl.[3] ..... E05G 1/026

[52] U.S. Cl. ..... 109/66; 232/44

[58] Field of Search ..... 109/66, 70, 71, 73, 109/2; 232/43.1, 43.2, 44, 57, 58, 60; 312/212, 211

[56] References Cited

U.S. PATENT DOCUMENTS

| | | | |
|---|---|---|---|
| 1,824,532 | 9/1931 | Robinson | 239/659 |
| 2,022,381 | 11/1935 | Mosler et al. | 109/1 |
| 2,465,431 | 3/1949 | Cisenfeld | 232/43.1 |
| 2,901,165 | 8/1959 | Krug | 232/44 |
| 2,963,333 | 12/1960 | Mestre | 346/22 |
| 3,539,095 | 11/1970 | James | 232/43.1 |
| 3,762,634 | 10/1973 | Leipelt | 232/44 |
| 3,990,630 | 11/1976 | Cutter | 232/44 |
| 4,063,520 | 12/1977 | Parsons | 109/66 |
| 4,176,610 | 12/1979 | Markham | 109/59 R |

*Primary Examiner*—Gene Mancene
*Assistant Examiner*—John G. Weiss
*Attorney, Agent, or Firm*—Geoffrey R. Myers; Darle M. Short

[57] ABSTRACT

A drawer-type night depository is disclosed which has a drawer which slides in and out of a housing embedded in a wall. The drawer has an unusable dead space in the front thereof and a partial floor comprised of spaced stationary fingers. The night depository also includes rotor fingers which are designed to rotate through the drawer as the drawer is closed. The item being deposited is placed on the stationary fingers. Then as the drawer is closed, the symmetric rotor fingers rotate between and through the stationary fingers, picking up the deposited item and flipping the deposited item through an opening in the drawer and housing into a bin below. The rotor fingers are fixedly attached to a shaft which passes through the drawer. The shaft is rotated by a clutch mechanism as the drawer is closed. The clutch mechanism is designed such that the shaft, and thus the rotor fingers, are rotated 180° each time the drawer is closed. In addition, apparatus is provided such that once the rotor fingers have begun to rotate, it is impossible to open the drawer to get access to the interior of the drawer. Some embodiments include apparatus which prevents the drawer from being closed once it has been opened a predetermined distance without completing a cycle to prevent jimmying of the door.

14 Claims, 18 Drawing Figures

NIGHT DEPOSITORY

BACKGROUND OF THE INVENTION

This invention relates to commercial banking equipment. More particularly, this invention relates to apparatus which enables bank customers to make deposits when the bank is closed, also known as night depositories.

In a variety of commerical situations, it is highly desirable to make deposits in a bank (or other banking institutions such as a savings and loan or a credit union) after the bank has closed for the day to ensure the safety of the deposits for the night. The deposits are usually comprised of the proceeds from the day's business of a commercial establishment, whether it be a restaurant, a theatre, a retail store, etc., which closes after the bank closes. The owners, operators and managers of such establishments usually prefer that these proceeds be taken directly to a bank for safekeeping at the end of the day rather than staying within the commercial establishment or within the custody of store personnel until the bank opens the next morning.

By depositing the proceeds directly in a bank, the possibility of the proceeds getting stolen is reduced since bank premises are usually much harder for a thief to break into than are commercial establishments, and it also reduces the risk of an employee in custody of the proceeds getting assaulted by a thief since the time the employee is in custody of the proceeds is greatly reduced. For these reasons, most commercial banking institutions, including savings and loans and credit unions, provide apparatus for the depositing of money after the banking institutions' operating hours, commonly known in the banking trade as night despositories.

These night depositories have generally been of three types; the drum cylinder type, the bin type (a v-shaped rotating bin having an axis of rotation which passes through near the bottom of the bin) and the drawer type. The night depositories according to this invention are of the last type, the drawer type.

These drawer-type night depositories usually run on casters or bearings and pull in and out of a housing. The items being deposited are placed in the drawer when the drawer is opened. Then when the drawer is closed, slots in the bottom of the drawer usually line up with an opening below and either this is enough to allow the deposited items to fall through to a bin below the drawer or a trap door is activated which drops the items into the bin.

However, none of these prior drawer-type night depositories or the night depositories of the drum cylinder or bin type are completely burglar-proof.

There are two methods of stealing something from a night depository commonly employed. The first method is by applying an adhesive in the interior of the night depository so that any subsequently deposited item will stick to the interior and not fall into the bin below when the drawer is closed or the bin or drum cylinder is rotated. The burglar can then open up the night depository after the legitimate user has left the scene and remove the valuables from the item stuck to the night depository.

The second method commonly used by a burglar is to drop a fish hook or other small grasping-type item on a line into the night depository and try and either bring the item back up through the apparatus of the night depository or reverse the normal operation of the apparatus to withdraw the deposited items from the night depository.

In addition to being susceptible to the above thievery, some of these prior art devices are very complex and involve many moving parts which may inadvertently and easily jam up or otherwise become inoperable, preventing further use of the night depository by legitimate users until it is serviced.

From the above, it is apparent that there is a need in the art for a night depository which is not susceptible to thievery by the adhesive or fish hook methods discussed above, and which is simple in construction and operation, yet effective and efficient.

This invention fulfills these needs in the art, plus other needs which will become apparent to the skilled artisan once given the following disclosure:

SUMMARY OF THE INVENTION

Generally speaking, this invention provides an apparatus for depositing items from the exterior to the interior of a wall comprising a drawer means for receiving the items on the exterior of said wall and transferring said items to the interior of said wall, a housing embedded in said wall, said drawer means being slidably located within said housing and having a closed position, said housing and said drawer means having openings therein which are in line when said drawer means is in said closed position, and, rotary means located within said drawer means for transferring said items from said drawer means through said openings, said rotary means including at least one rotor finger which rotates through said drawer means as said drawer means is closed and transfers any deposited items through said openings.

In certain embodiments, a clutch means is provided for operating the rotary means. The clutch means is rotatably mounted on a shaft which passes through the drawer means. The rotor finger is fixedly attached to this same shaft.

The clutch means may include a clutch gear which rotates around the shaft and a rack which is attached to the side of the housing. The teeth of the clutch gear engage the rack and rotate the clutch gear as the drawer means is opened and closed.

The rotary means may include a clutch dog holder that has swingably attached thereto at least one clutch dog and which is also fixedly attached to the shaft. The clutch dog interfaces the clutch gear, in particular, a slanted raised surface on the clutch gear which faces the clutch dog holder. The slanted raised surface has a ledge at one end thereof. As the drawer means is opened and the clutch gear is rotated, the clutch dog rides along and up the slanted surface and then drops off the same at the ledge. However, when the drawer means is closed, such that the direction of the clutch gear is reversed, the clutch gear, in particular, the ledge of the slanted surface will engage the clutch dog and cause the clutch dog holder, and thus the shaft and rotor finger, to rotate. The rotor finger will then pick up any item deposited in the drawer means and flip it through the openings.

The rotor fingers may be symmetric about the shaft so that when rotated 180°, the rotor fingers will have the same configuration with respect to the shaft and the drawer means as the rotor fingers had before they were rotated. The bottom of the drawer means may be comprised of a number of spaced stationary fingers upon which the items being deposited are placed. When the clutch gear engages and rotates the clutch dogs, etc., the rotor fingers pass through the stationary fingers and pick up the deposited item.

Certain embodiments of this invention may include apparatus to prevent a person from reversing the direction of the drawer means once the drawer means has been opened a predetermined distance. This means may be comprised of an elongated ratchet attached to the side of the housing, a first guide bar slidably attached to the drawer means and a second guide bar attached to the side of the housing and extending under the ratchet stop. The first guide bar may have a pin extending therefrom which rides along the elongated ratchet and the second guide bar as the drawer means is opened and closed. The pin rides along the teeth of the ratchet (the teeth are along the top of the ratchet) as the drawer means is opened from the closed position. After the pin has gone the length of the ratchet, it drops down to the second guide bar and moves along the second guide bar as the drawer means is continued to be opened. While the pin is in engagement with the ratchet, the teeth are shaped such that the direction of the pin and the drawer means can not be reversed. The length of the ratchet is important since the drawer means may have a dead space located in the front thereof which has a top plate making the interior thereof inaccessible to persons. The rest of the drawer means is where the deposits are placed and carried. The length of the ratchet is such that until the pin drops off the ratchet, only the dead space is accessible to persons outside the wall.

The second guide bar also has a notched tooth in it which the pin will pass when the drawer means is closed. This notched tooth is designed such that once the pin passes by it, going forward on the second guide bar, the pin can not go back directly across the notched tooth. Since when the pin is in, or in front of, the notched tooth, only the dead space of the drawer means is accessible to persons outside the wall, a person can not re-open the drawer means once the drawer means has been closed to a degree that the pin is in front of or in the notched tooth.

This invention may also include a sprocket which is attached to the shaft and a pawl which is attached to the housing. The pawl has a head which engages the sprocket to prevent the sprocket and thus the shaft and rotor fingers from rotating in the unwanted direction.

The above combination and configuration of elements prevents both types of thievery (adhesive and fish hook and line) discussed above and is relatively simple mechanically, thus greatly reducing the chances of mechanical failures. The adhesive thievery is prevented since if the adhesive is applied and the deposited items become stuck to the rotor fingers the thief will still be unable to bring the deposits back to where the thief has access to them since the rotor fingers will only go in one direction and the stationary fingers will prevent the deposits from being brought forward. The fish hook and fish line type of thievery will be prevented since it is impossible to bring an item back through the apparatus.

In addition to preventing these well-known types of thievery and other modes of thievery, it is believed that the night deposits built according to this invention are virtually fail safe if properly serviced.

The invention will now be described with respect to the embodiments shown in the Figures wherein:

IN THE DRAWINGS

DETAILED DESCRIPTION OF THE DRAWINGS

Figure 2:
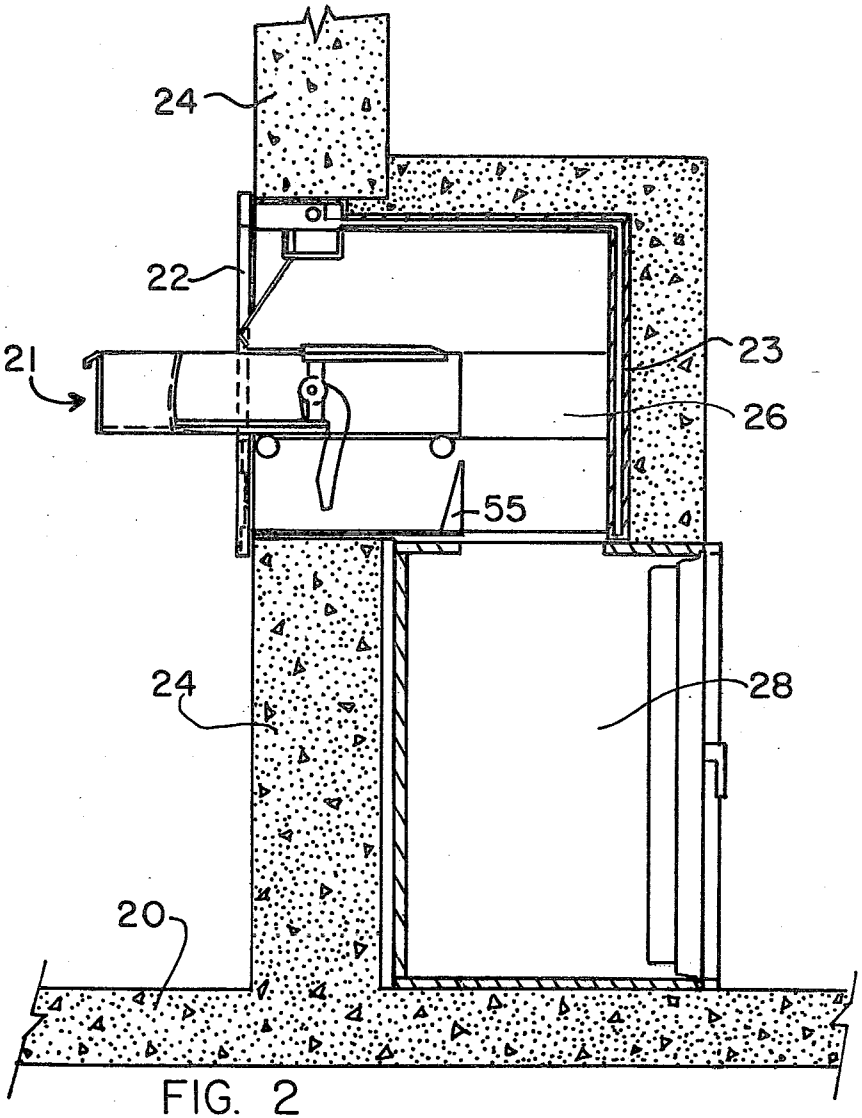
FIG. 2 is a sectionalized side view of the embodiment of this invention illustrated in FIG. 1 showing the night depository drawer in the open position.
Figure 1:
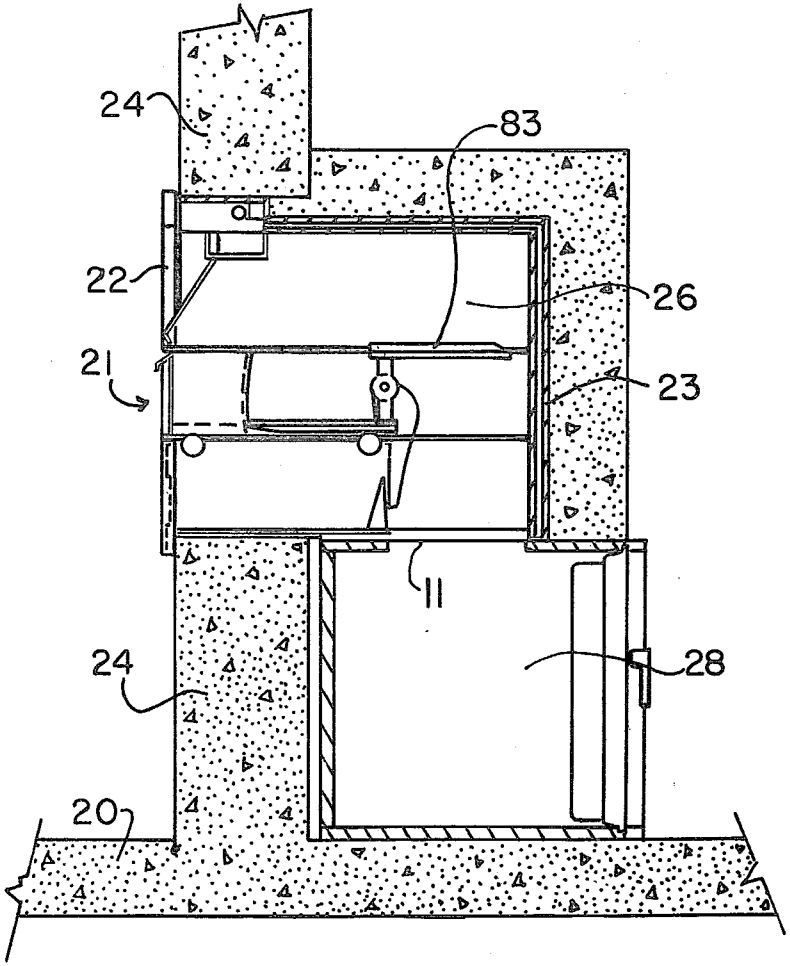
FIG. 1 is a sectionalized side view of one embodiment of this invention illustrating the night depository drawer in the closed position.

Referring to the Figures, a night depository apparatus is disclosed which includes drawer 21 located within a housing 23. The night depository is designed to receive deposits when the bank is closed. The night depository is usually located within an exterior wall of the bank, such as wall 24, and has its front 22 accessible to customers standing outside of the bank on sidewalk 20.

The night depository shown in the Figures is comprised of drawer unit 26 (which includes drawer 21) which is in housing 23 and lower bin 28 which opens up into the interior of the bank. There is opening 11 in the bottom of the housing 23 and drawer unit 26 which is in line with an opening in the top of bin 28. The deposited envelopes, bags, or other items pass through this opening when the night depository is operated.

Drawer unit 26 includes front plate 103, back plate 105, side plates 107 and bottom plate 109. Drawer unit 26 is contained within and is attached (such as by bolt assemblies 30) to housing 23, which in turn is embedded in wall 24. Drawer unit 26 in this embodiment includes light assembly 51 which provides light for users of the night depository.

Figure 6:
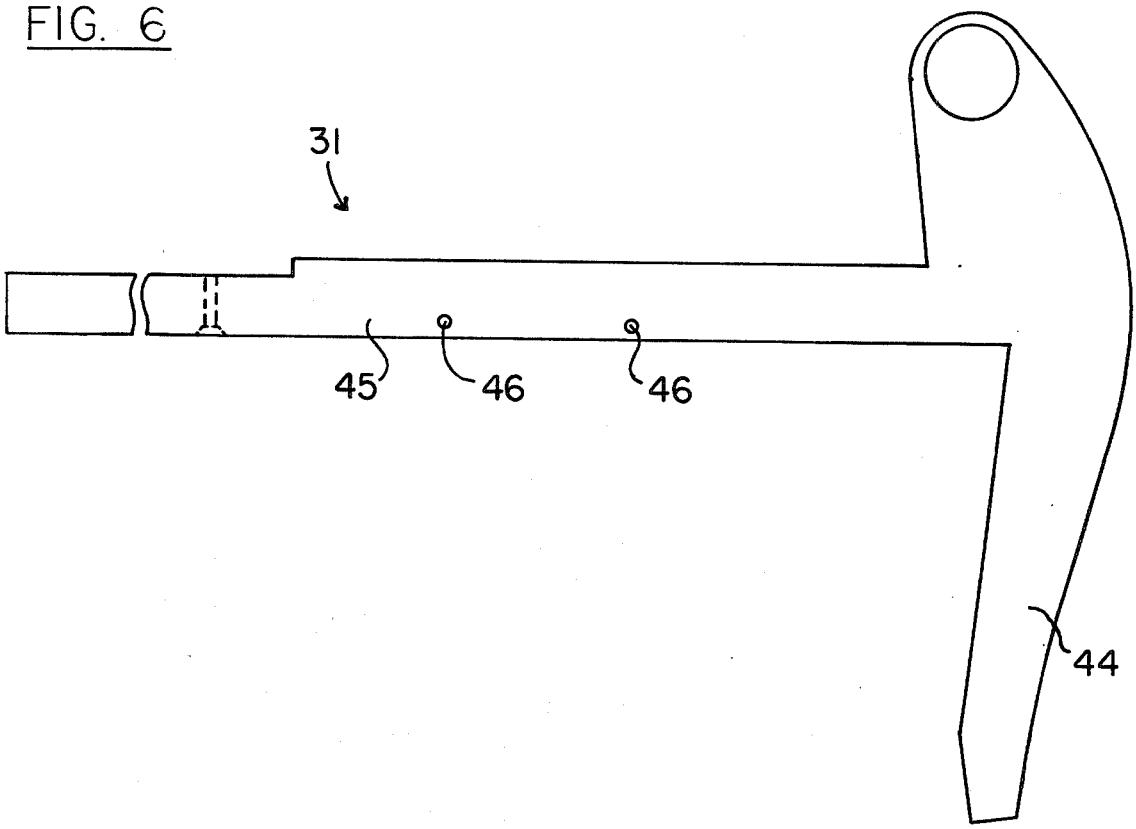
FIG. 6 is a side view of one embodiment of the stationary fingers which can be incorporated in the embodiment of this invention illustrated in FIGS. 1–5.

Drawer 21 is comprised of front panel 25, back panel 27, side panels 29 and a floor consisting of spaced stationary fingers 31. In addition, drawer 21 has a handle flange 32 extending from the front thereof to facilitate the opening and closing thereof. Stationary fingers 31 are shaped as shown in Figure 6 having a lower portion 44 and a horizontal portion 45 and are spaced apart a distance that will be discussed below. The bags, envelopes and other items, when deposited in drawer 21, are placed on horizontal portions 45. Stationary fingers 31 also have holes 46 therein to receive rollers 84.

Dead space 33 is designed into the front of drawer 21, for reasons discussed below, by having a box 35 located in the front of drawer 21. Note that the interior of box 35 is not accessible from the top or interior of drawer 21. The rest of drawer 21 is comprised of free space 34 and is the only portion of drawer 21 which is actually employed for the depositing of bags, envelopes and other items.

Drawer 21 slides in and out of housing 23 on ball bearings 37, 39 and 41. Ball bearings 37 are attached to side plates 107 by brackets 43. Likewise, ball bearings 39 are attached to side plates 107 by brackets 47. Ball bearings 41 are directly attached to side walls 29 of drawer 21. Not only do ball bearings 37, 39 and 41 function to reduce frictional resistance forces when drawer 21 is slid in and out, ball bearings 37, 39 and 41 also guide drawer 21 when it is being slid in and out during usage by customers.

Rotatably passing through drawer 21, in the middle of free space 34 and oriented parallel to front wall 25 and back wall 27, is shaft 81. Shaft 81 has rotor fingers 83 fixedly attached thereto and spaced therealong such that when shaft 81 rotates, so do rotor fingers 83. Also fixedly attached to shaft 81 by key stock 82 are clutch dog holder 89 and sprocket 95, both of which are described in more detail below.

Figure 7:
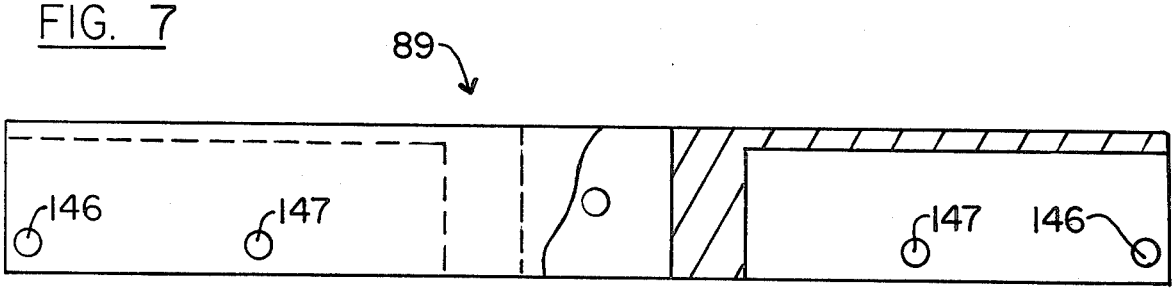
FIG. 7 is a top view, partially sectionalized, of a clutch dog holder which can be incorporated into the embodiment of this invention illustrated in FIGS. 1–5.
Figure 8:
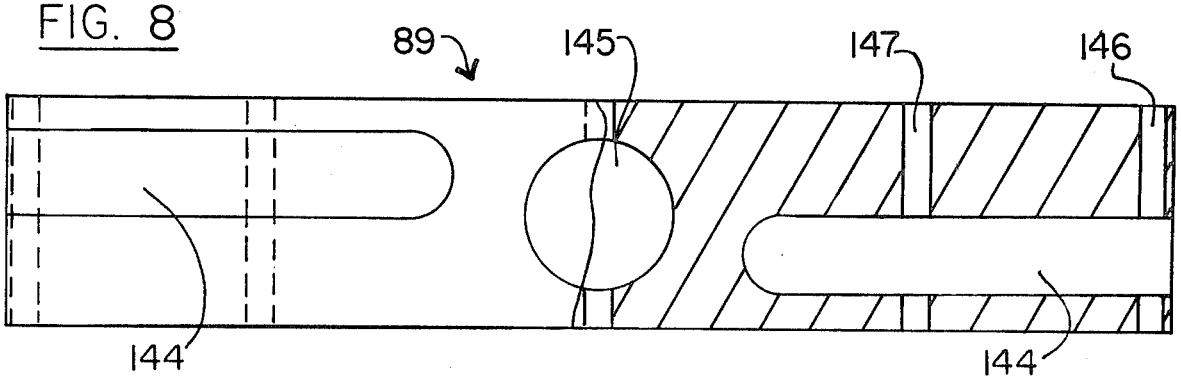
FIG. 8 is a side view, partially sectionalized, of the clutch dog holder illustrated in FIG. 7.
Figure 9:
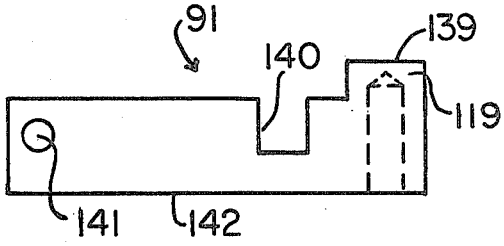
FIG. 9 is a top view of a clutch dog which can be incorporated in the embodiment of this invention illustrated in FIGS. 1–5.
Figure 10:
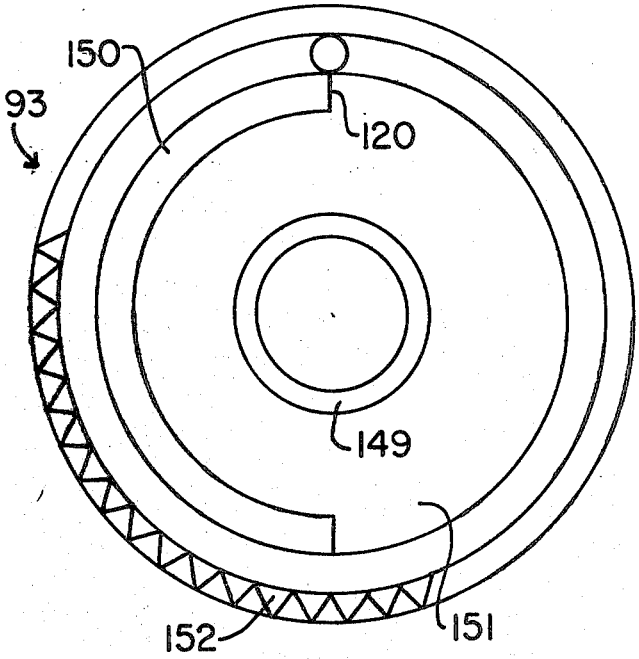
FIG. 10 is a side view of a clutch gear which can be incorporated in the embodiment of this invention illustrated in FIGS. 1–5.
Figure 11:
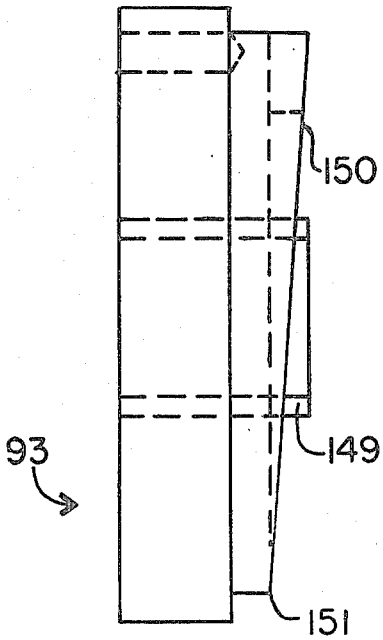
FIG. 11 is a front view of the clutch gear illustrated in FIG. 10.

A clutch assembly is provided which is comprised of clutch dog holder 89, clutch dogs 91, clutch gear 93 and bearing 94. Clutch dogs 91 are illustrated in FIG. 9 and have heads 119 including clutch gear bearing surfaces 139, bearing pin indentations 140, holes 141 and bottom edges 142. Clutch dog holder 89 is illustrated in FIGS. 7 and 8 and has clutch dog indentations 144 and holes 145, 146 and 147 therein. Clutch gear 93 is illustrated in FIGS. 10 and 11 and includes bearing 149, slanted raised surface 150, with ledge 120 at one end thereof, top surface 151 and teeth 152. Slanted raised surface 150 is in the shape of a semi-circle and begins at one end at the same level as the top surface 151 and runs at an angle up to ledge 120.

Figure 12:
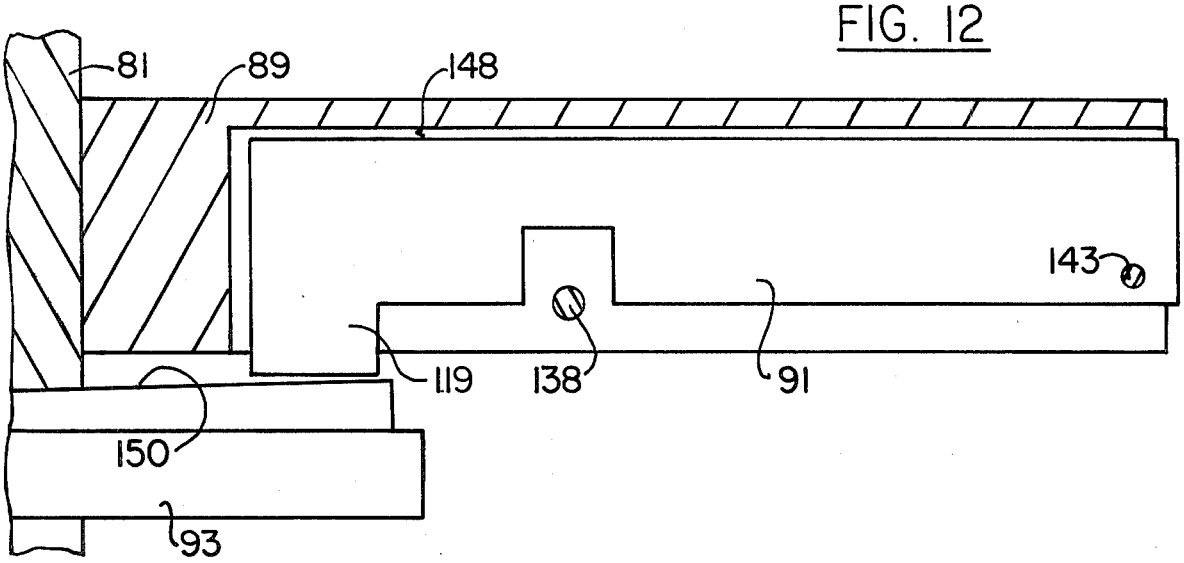
FIG. 12 is a side view, partially sectionalized, of the clutch gear, clutch dog and clutch dog holder illustrated in FIGS. 7–11 assembled together, with the clutch dog in its innermost position riding on the raised surface of the clutch gear.
Figure 13:
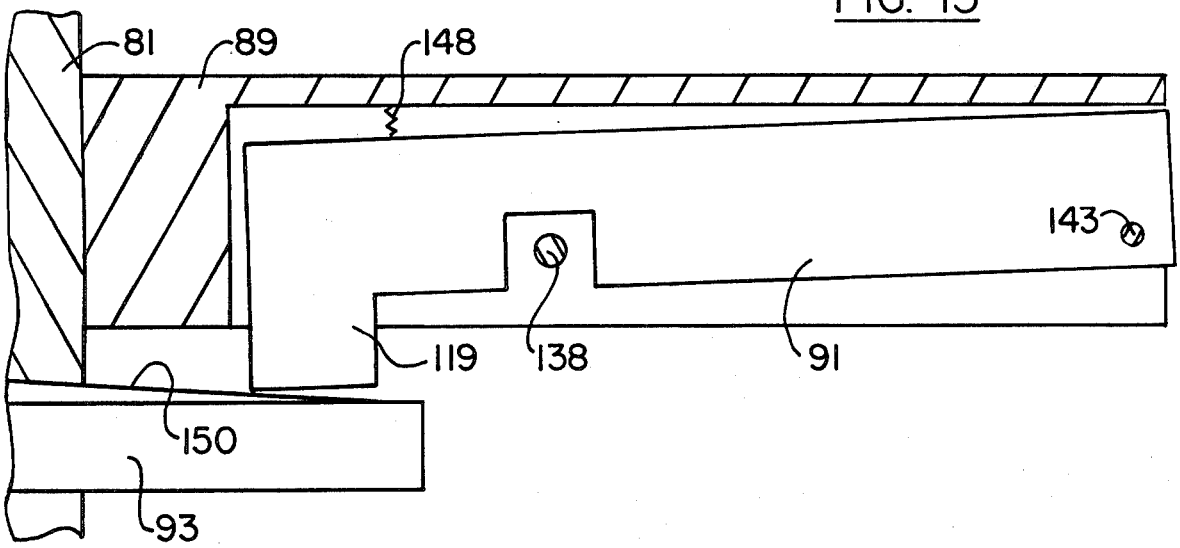
FIG. 13 is the same view as FIG. 12 showing the clutch dog riding on the lower portion of the raised surface of the clutch gear.
Figure 14:
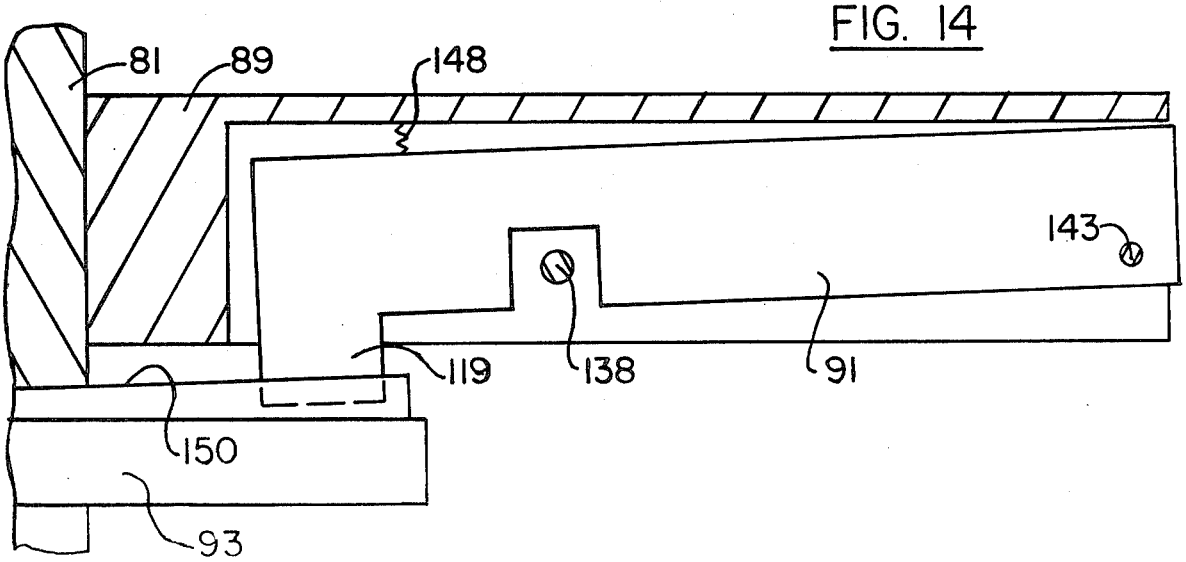
FIG. 14 is the same view as FIGS. 12 and 13 showing the clutch dog riding on the flat portion of the clutch gear, engaged by the clutch gear.

Clutch dog holder 89 is fixedly attached to shaft 81, shaft 81 passing through hole 145. Shaft 81 also passes through clutch gear 93, but is not fixedly attached thereto. Clutch gear 93 is spaced along shaft 81 from clutch dog holder 89 a predetermined distance. Clutch dogs 91 are placed within clutch dog indentations 144 of clutch dog holder 89 with bottom edges 142 facing downward or into indentations 144. Clutch dogs 91 are then rotatably attached to clutch dog holders 89 by pins 143 which pass through holes 141 in clutch dogs 91 and holes 146 in clutch dog holder 89. Springs 148 are attached to and extend between clutch dogs 91 and clutch dog holder 89 as shown in FIGS. 12–14. Springs 148 are designed to push clutch dogs 91 outward, towards clutch gear 93. Bearing pins 138 are passed through holes 147 in clutch dog holder 89 and bearing pin indentations 140 in clutch dogs 91 and are designed to prevent clutch dogs 91 from being overextended, i.e. from being pushed too far out of clutch dog indentations 144 by springs 148.

Figure 16:
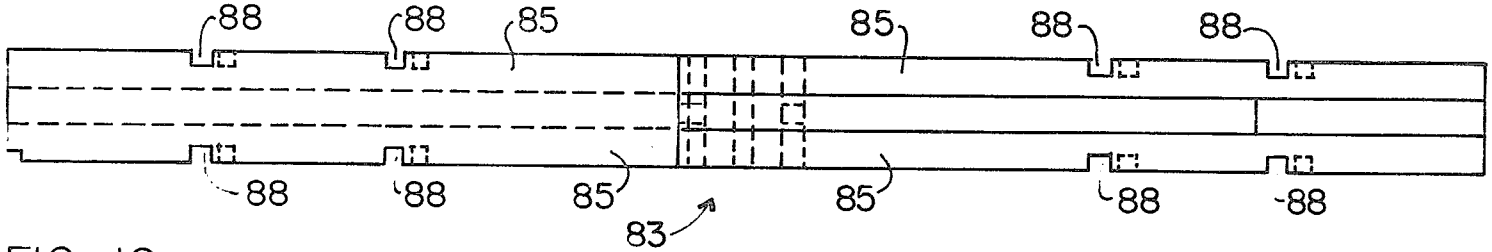
FIG. 16 is a top view of the rotor finger illustrated in FIG. 15.
Figure 15:
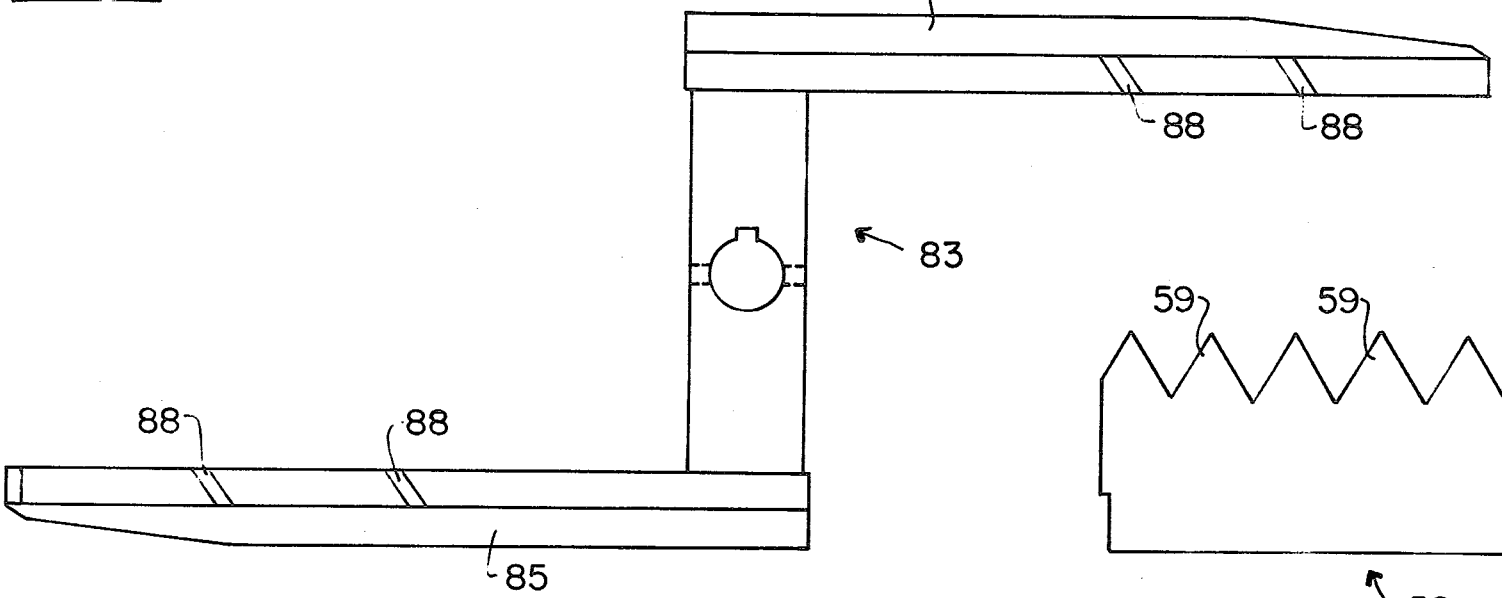
FIG. 15 is a side view of a rotor finger which can be incorporated in the embodiment of this invention illustrated in FIGS. 1–5.

Also fixedly attached to shaft 81 are rotor fingers 82 which are illustrated in FIGS. 15 and 16. Rotor fingers 83 are comprised of finger portions 85 which have notches 88 spaced therein and a body portion which connects finger portions 85. Rotor fingers 83 are spaced along shaft 81 in between stationary fingers 31 such that when rotor fingers 83 rotate, finger portions 85 pass through the spaces between stationary fingers 31. Note that rotor fingers 83 are symmetric about shaft 81 so that the orientation of finger portions 85 relative to the rest of the night depository is the same after rotor fingers 83 have been rotated 180°.

Stationary fingers 31 have rollers 84 passing therethrough and extending therefrom which are received in notches 88 of rotor fingers 83. Rollers 84 are provided so that a thief is not able to pull an envelope up through the spaces between adjacent stationary fingers 31 and rotor fingers 83.

Clutch gear 93 is placed on shaft 81 with its raised surface 150 facing clutch dog holder 89 and clutch dogs 91. Clutch bearing surfaces 139 of clutch dogs 91 abut raised surface 150 and top surface 151 and ride along the same as clutch gear 93 is rotated relative to shaft 81 and clutch dog holder 89 as follows.

When drawer 21 is pushed in and out of drawer unit 26, clutch gear 93 engages and rolls along rack 99 which is fixedly attached to housing 23 by rack brackets 100. Shaft 81 and thus clutch dog holder 89 are horizontally pulled along by clutch gear 93. However, shaft 81 does not rotate until clutch dogs 91 engage clutch gear 93 when drawer 21 is being returned to its closed position, as will be discussed in detail below.

Figure 4:
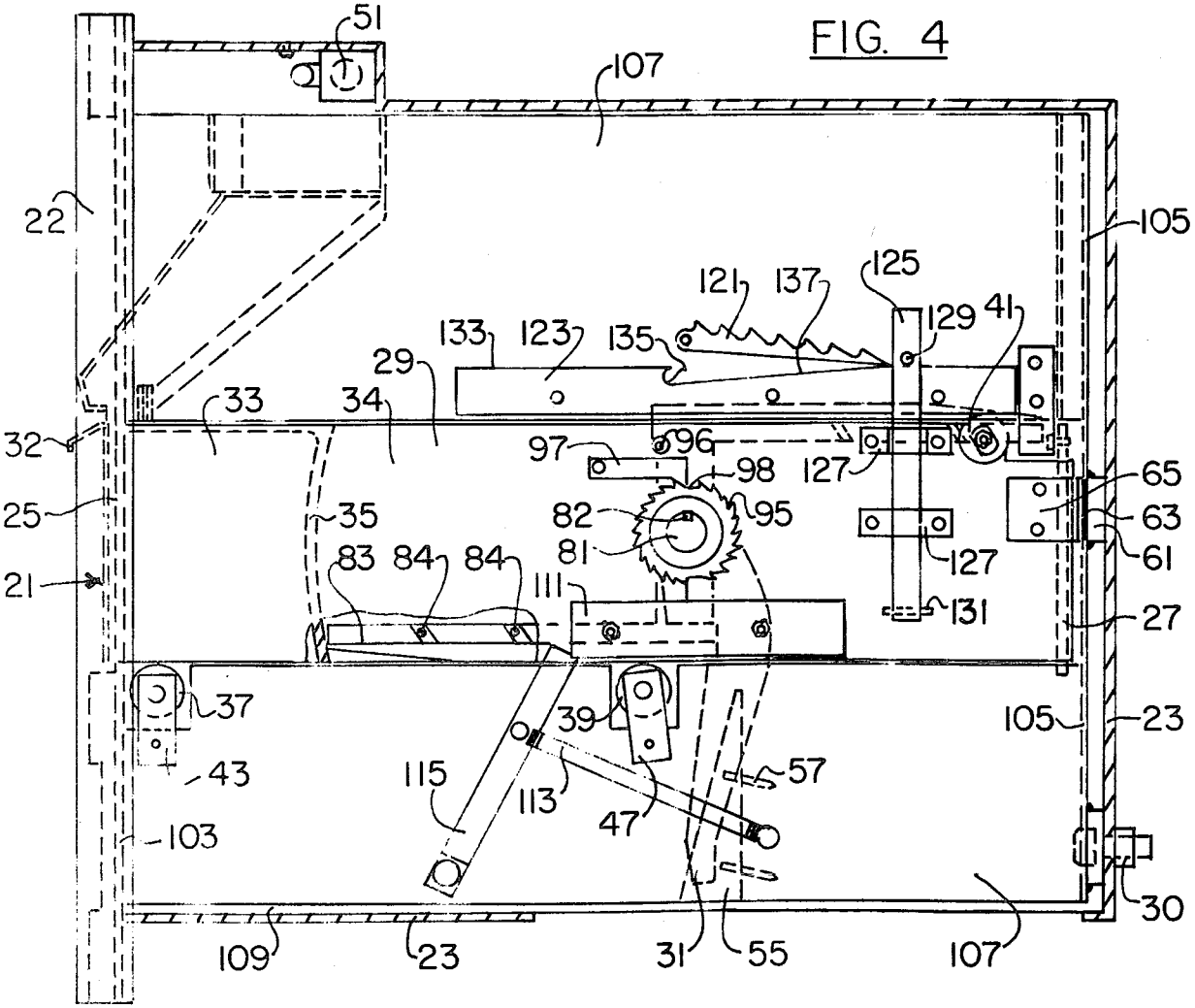
FIG. 4 is a side view, partially sectionalized, of the embodiment of this invention illustrated in FIGS. 1–3, with the side of the housing removed, showing the side opposite from the side illustrated in FIG. 3.
Figure 5:
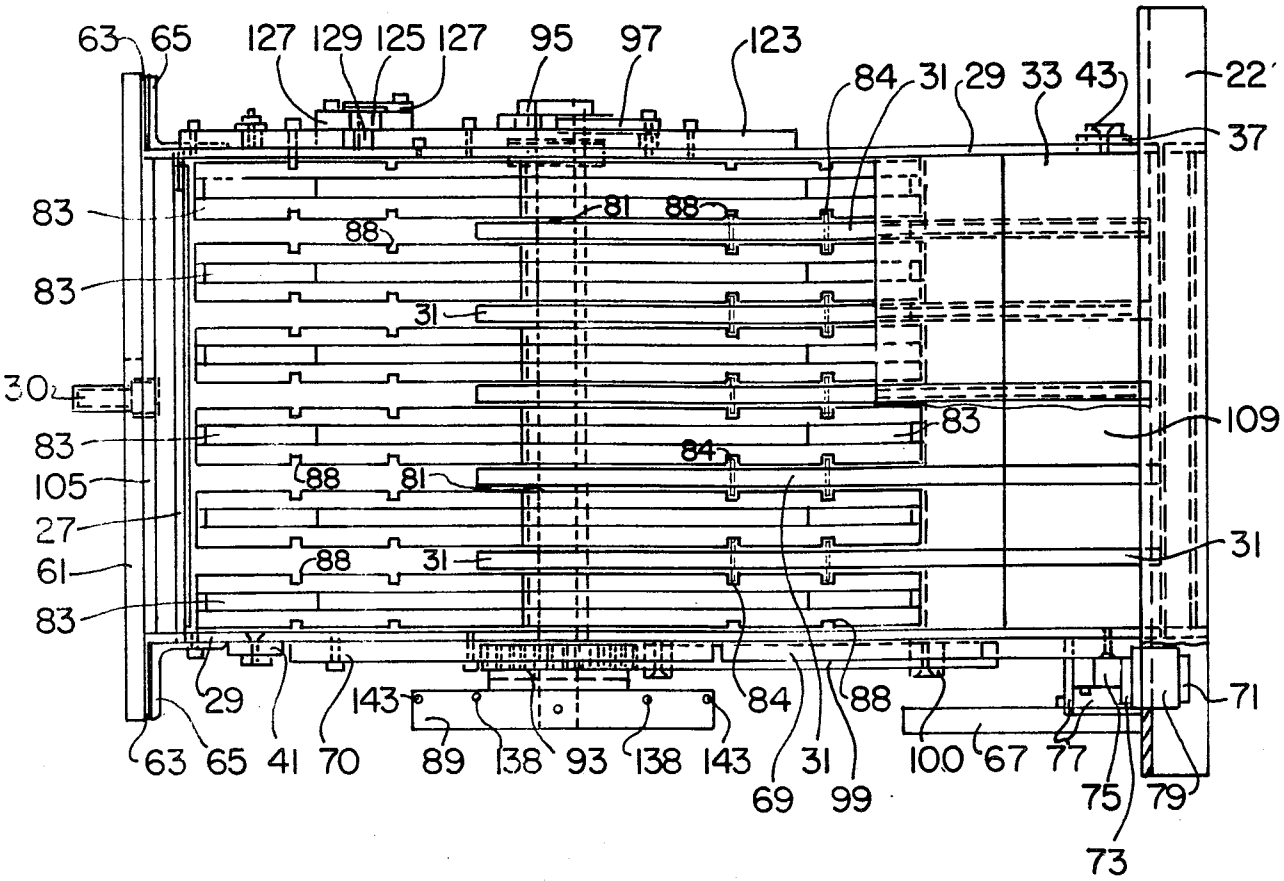
FIG. 5 is a plan view of the embodiment of this invention illustrated in FIGS. 1–4, with the housing removed.

The embodiment of the invention illustrated in the Figures includes an assembly to prevent rotor fingers 83 from being rotated in the direction which would allow bags or envelopes to be taken from bin 28 to drawer 21 (counterclockwise as shown in FIG. 4). This assembly is comprised of sprocket 95 which is fixedly attached to shaft 81 and pawl 97 which is rotatably attached to housing 23. The leading edge 98 of pawl 97 engages the teeth of sprocket 95 and prevents sprocket 95 and thus shaft 81 and rotor fingers 83 from rotating in the unwanted direction. A pawl stop 96 is attached to housing 23 a predetermined distance above pawl 97 so that pawl 97 can not be flipped over, either accidentally or intentionally by a potential thief, rendering pawl 97 and sprocket 95 inoperative.

Bumper pads 63 are attached to drawer 21 by bumper support brackets 65 which are in turn attached to side walls 29 of drawer 21. Bumper pads 63 are designed to extend a predetermined distance behind drawer 21 so that when drawer 21 is closed, only bumper pads 63 come in contact with a stationary surface.

Attached to the back side of housing 32 opposite back wall 27 of drawer 21 and bumper pads 63 is bumper bar 61 which is designed to interface bumper pads 63 whenever drawer 21 is closed.

The embodiment of this invention illustrated in the Figures includes apparatus for ensuring that the drawer, once it has begun to be opened, must be opened a predetermined distance before it can be closed. This apparatus includes ratchet stop 121 which is pivotally attached to side plate 107, guide bar 123 which is fixedly attached to side plate 107 and guide bar 125 which moves up and down within guide bar brackets 127. Guide bar brackets 127 are attached to a side wall 29 of drawer 21 and are shaped to slidably receive guide bar 125 therein.

Guide bar 125 has pin 129 perpendicularly extending therefrom. Also, guide bar 125 has roll pin 131 rotatably passing therethrough near the bottom thereof. Roll pin 131 performs the function of preventing guide bar 125 from being accidentally or intentionally lifted all the way out of guide bar brackets 127.

Guide bar 123 has a top level portion 133, a notched tooth 135 and a sloped portion 137. This apparatus is designed such that, when drawer 21 is pulled open, rod 129 rides along the top of ratchet stop 121 over its teeth until rod 129 reaches the end of ratchet stop 121, at which time rod 129 drops off of ratchet stop 121 onto level portion 133. If drawer 21 is continued to be opened, rod 129 rides along level portion 133 to the left (as shown in FIG. 4). When drawer 21 is closed, pin 129 rides back along level portion 133 until it drops into notched tooth 135. Then as drawer 21 is continued to be closed, pin 129 rides up sloped portion 137 and pushes up ratchet stop 121 to continue thereunder to return to its original closed position. Note that once pin 129 reaches and passes the notched tooth 135 on its return trip, drawer 21 can not be re-opened without closing drawer 21 all the way shut. This feature is important for reasons discussed below.

A spring return assembly is included in the embodiment of this invention shown in the Figures. This return assembly includes glide bar 111 which is attached to a side wall 29 of drawer 21, spring 113 and tripper bar 115 which has one of its ends rotatably attached to housing 23. Spring 113 is connected at its ends to housing 23 and to tripper bar 115 (a predetermined distance from where tripper bar 115 is rotatably attached to housing 23). The other end of tripper bar 115, leading edge 117, abuts glide bar 111. As can be seen from FIG. 4, whenever drawer 21 is opened, tripper bar 115 is swung about its axis of rotation by glide bar 111, stretching spring 113 and placing spring 113 in tension. This results in a force tending to close drawer 21 whenever drawer 21 is opened.

A locking mechanism is included within this embodiment of the invention to prevent unauthorized use of the night depository. This mechanism includes a key lock 71, cam 73, locking bar 75, guide brackets 77, lock ring 79, drawer stops 67 and 69, locking device 68 and drawer guide 70.

Key lock 71 is embedded within the front of drawer unit 26. Lock ring 79 is placed around key lock 71 to properly protect key lock 71. Attached to the back side of key lock 71 is cam 73 which is a cylindrical member. Note however, that the center axis of cam 73 is offset from the centerline axis of key lock 71 when the two are properly attached together, resulting in cam 73 acting in a cam-like manner with respect to the centerline of key lock 71 when key lock 71 is rotated.

Figure 3:
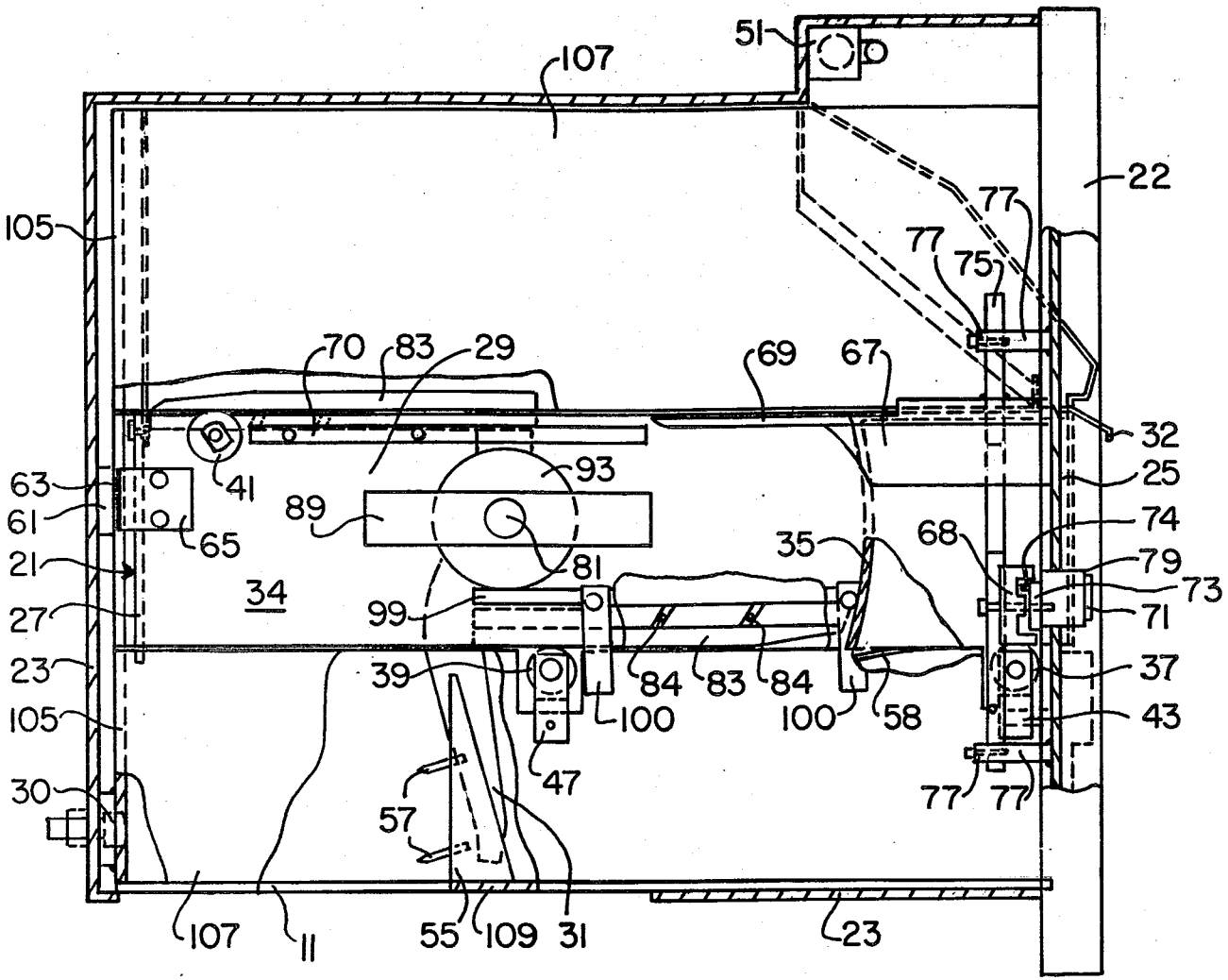
FIG. 3 is a side view, partially sectionalized, of the embodiment of this invention illustrated in FIGS. 1 and 2, with the side of the housing removed.

Locking bar 75 is slidably received within guide brackets 77 which are attached to a side plate 29 of drawer 21. Attached to locking bar 75 directly opposite key lock 71 and cam 73 is locking device 68. Also attached to locking bar 75 perpendicularly thereto are drawer stops 67 and 69. Drawer guide 70 is attached to drawer 21 in the position shown in FIG. 3.

Figure 17:
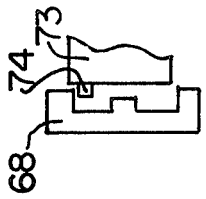
FIG. 17 is an enlarged view of the cam and locking device illustrated in FIG. 3.

Cam 73 has a pair of pins 74 which extend out perpendicularly from cam 73 in the opposite direction from key lock 71. Pins 74 engage locking member 68 as shown in FIG. 17 and push locking device 68 (and thus locking bar 75 and drawer stops 67 and 69) upwards when key lock 71 is turned from its locked position to its open position.

When drawer 21 is shut and key lock 71 is in the lock position, drawer stop 69 is in line with drawer guide 70 and thus prevents drawer 21 from being opened. When key lock 71 is rotated a specified arc, pins 74 will push locking bar 75 and thus drawer stop 69 upwards such that drawer guide 70 can slide under drawer stop 69. Drawer 21 can then be opened a distance until drawer stop 67 abuts clutch dog holder 89 and prevents further opening of drawer 21. When drawer 21 is opened such that clutch dog holder 89 abuts drawer stop 67, a small slot of free space 34 is accessible to the user of the night depository so that the user can deposit envelopes therein. To further open drawer 21, key lock 71 must be further rotated until drawer stop 67 clears clutch dog holder 89. When key lock 71 has been so turned, drawer 21 can be completely opened, allowing a user to deposit bags or other bulky items. As an additional safety measure, different keys may be required to turn key lock 71 to its completely open position.

Fingers 55 (see FIGS. 3 and 4) are attached to bottom plate 109 of drawer unit 26 and are spaced apart to allow rotor fingers 83 to pass therebetween. Fingers 55 have spikes 57 embedded therein and extending therefrom in the direction shown in FIGS. 3 and 4. Fingers 55 and spikes 57 are designed to prevent thieves from retrieving bags or envelopes once the same have passed into bin 28. If someone attempts to remove a bag or envelope from bin 28 back up through drawer unit 26, the bag or envelope will snag on fingers 55 and spikes 57 such that the person will not be able to carry out his or her intended plan.

Figure 18:
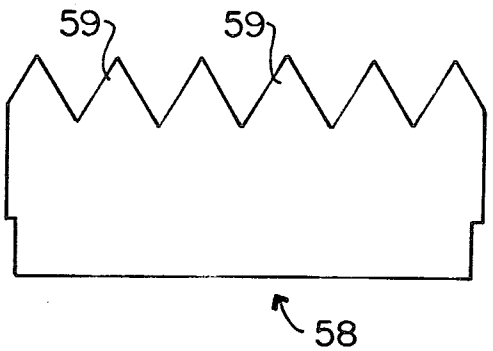
FIG. 18 is a top view of a drawer guard which can be incorporated in the embodiment of this invention illustrated in FIGS. 1–5.

The embodiment of the invention illustrated in the Figures also includes a safety measure to prevent a potential thief from trying to get an envelope out under drawer 21. This safety measure comprises drawer guard 58 (shown in FIGS. 3 and 18) which is attached to the bottom of drawer 21 and extends the width of drawer 21. Drawer guard 58 has teeth 59, some of which are angled downward so that an envelope being removed will be caught on teeth 59.

The embodiment of this invention illustrated in the Figures operates and is utilized as follows. A person desiring to use this embodiment would walk up to front panel 22 on sidewalk 20. The person would then insert a key in key lock 71 and by turning the key unlock drawer 21 so that drawer 21 would be free to be pulled open as discussed above. If the person does not have the proper key, drawer stop 69 would be in its lower position, preventing drawer 21 from being opened.

After key lock 71 has been turned, freeing drawer 21 to be opened, the person next grips handle 32 and pulls drawer 21 open. As drawer 21 is being pulled open the following occurs.

Guide bar 124, which is attached to drawer 21, is pulled forward with drawer 21. Pin 129, attached to guide bar 124, engages ratchet stop 121 and moves up and along the teeth of ratchet stop 121. Note that once drawer 21 has been opened to the extent that pin 129 engages ratchet stop 121, the drawer can not be closed until pin 129 clears the end of ratchet stop 121. This feature prevents a thief from jimmying with drawer 21 to try and withdraw something from bin 28 below it. This feature also provides other safety measures which have been discussed above and will be described in detail below.

As drawer 21 is further pulled out, pin 129 drops off ratchet stop 121 and rests and rides on guide bar 123, more specifically, on level portion 133 of guide bar 123. Pin 129 rides on level portion 133 until drawer 21 has been pulled open its maximum distance. Then as drawer 21 is closed, pin 129 rides back along level portion 133 until it reaches and drops into notched tooth 135. Once pin 129 has dropped into notched tooth 135, drawer 21 can not be reopened further without closing drawer 21 all the way, in other words, until pin 129 is in front of ratchet stop 121. When drawer 21 is closed all the way, pin 129 rides up slanted portion 137 back to its original starting position as shown in FIG. 4, pushing ratchet stop 121 up as it passes thereunder.

As drawer 21 is being pulled open, the following also occurs. Shaft 81 (which is rotatably received by drawer 21) and all the elements attached thereto and encompassing it (including clutch gear 93) are pulled along with drawer 21. The teeth of clutch gear 93 are in engagement with rack 99 (which is affixed to housing 23 and thus remains stationary) and rotate clutch gear 93 as drawer 21 is opened. Clutch gear bearing surfaces 139 of clutch dogs 91 bear on slanted raised surface 150 and top surface 141 of clutch gear 93. When drawer 21 is in its closed position the head 119 of one of the clutch dogs 91 is proximate to ledge 120, while head 119 of the other clutch dog 91 is resting 180° from ledge 120 or proximate to where slanted surface 150 begins. As drawer 21 is pulled open, clutch dog holder 89 (as well as clutch dogs 91) moves sideways with drawer 21 but does not rotate. Clutch gear 93 is rotating counterclockwise (as shown in FIG. 10). Thus, as clutch gear 93 rotates, the bearing surface 139 and head 119 which has started at the beginning of slanted raised surface 150 rides along and up slanted raised surface 150. Just as the backside of box 35 clears front 22 such that free space 34 is accessible to persons on sidewalk 20, the head 119 drops off slanted raised surface 150 at ledge 120 and comes to rest on top surface 151 adjacent ledge 120. Once a head 119 has dropped off ledge 120 as drawer 21 is opened, if the direction of drawer 21 is reversed, this head 119 will engage ledge 120. If drawer 21 is then pushed closed, clutch gear 93 will rotate clockwise (as shown in FIG. 10), causing ledge 120 to push on head 119. This will in turn cause clutch dog 91 and thus clutch dog holder 89 to rotate along with clutch gear 93. Since clutch dog holder 89 is fixedly attached to shaft 81 and rotor fingers 83 are also fixedly attached to shaft 81, rotor fingers 83 will also rotate as drawer 21 is closed. Clutch gear 93 and the other apparatus is designed such that rotor fingers 83 rotate 180° every time drawer 21 is closed.

Note that head 119 of clutch dog 91 drops off of ledge 120 just as drawer 21 is opened such that free space 34 is accessible to persons outside the bank. Thus, every time drawer 21 is opened this far or farther, a head 119 of a clutch dog 91 will engage ledge 120 and when drawer 21 is closed, rotate rotor fingers 83.

Once drawer 21 has been opened past box 35, free space 34 becomes accessible to the user of the night depository. The user then puts the items being deposited in free space 34 on top of stationary fingers 31 and one set of finger portions 85 of rotor fingers 83. As rotor fingers 83 are rotated when drawer 21 is closed as discussed above, any bag, envelope or other items deposited in free space 34 will be carried and flipped over into bin 28.

Sprocket 95 and pawl 97 are provided to prevent potential thieves from reversing the direction of rotor fingers 83 to retrieve something from bin 28. As discussed above, sprocket 95 is attached to shaft 81. The teeth of sprocket 95 are angled such that pawl 97 prevents sprocket 95, and thus shaft 81 and rotor fingers 83, from rotating in the unwanted direction.

The above described design and operation incorporates many safety features, including the following. First, every time drawer 21 is opened a small predetermined distance, pin 129 of guide bar 125 will engage ratchet stop 121. Once pin 129 engages ratchet stop 121 drawer 21 must be pushed open a distance until pin 129 falls off ratchet stop 121. When drawer 21 is pushed open that far, a head 119 of a clutch dog 91 has moved past ledge 120 of gear clutch 93, and when the drawer is then closed, the ledge 120 will engage this head 119 and rotate shaft 81 and rotors 83. Therefore every time drawer 21 is opened beyond a small distance, it must run a complete cycle rotating rotor fingers 83 and clearing out free space 34 before it can be closed to be reopened.

Furthermore, once pin 129 passes notched tooth 135 of guide bar 123 as drawer 21 is being closed, drawer 21 can not be opened past this point without completely rotating rotor fingers 83 through a cycle. And since when drawer 21 is open such a distance that pin 129 is in or in front of notched tooth 135 free space 34 is not accessible to a user, a thief can not gain access to free space 34 if a previous user forgot to close drawer 21 all the way. In other words, when drawer 21 is in a position such that rod 129 is in or is before notched tooth 134, but under ratchet stop 121, only dead space 33 will appear to the user of the night depository.

Moreover, this design ensures that rotor finger 83 will always be completely turned whenever free space 34 is accessible to the user. It is impossible for rotor fingers 83 to be in a mid-cycle when a user would have access thereto. Rotor fingers 83 are always in perfect synchronization with the rest of the elements of drawer 21.

The use of sprocket 95 and pawl 97 also performs the function of preventing shaft 81, and thus rotor finger 83, from rotating in the unwanted direction for any reason, including the frictional force of clutch dogs 91 running along clutch gear 93 as drawer 21 is opened.

Many other embodiments, improvements and modifications of this invention will become apparent to the skilled artisan once given the above disclosure. Such embodiments, improvements and modifications are considered to be within the scope of this invention as defined by the following claims.

I claim:

1. An apparatus for depositing items from the exterior to the interior of a wall comprising:

a drawer means for receiving the items on the exterior of said wall and transferring said items to the interior of said wall, a housing embedded in said wall, said drawer means being slidably located within said housing and having a closed position, said housing and said drawer means having openings therein which are in line when said drawer means is in said closed position, and, rotary means located within said drawer means for transferring said items from said drawer means through said openings, said rotary means including at least one rotor finger which rotates through said drawer means as said drawer means is closed and transfers any deposited items through said openings.

2. An apparatus according to claim 1 further comprising:

a clutch means for operating said rotary means, said clutch means being attached to said drawer means, said clutch means engaging said rotary means as said drawer means is closed to cause said rotary means to rotate.

3. An apparatus according to claim 2 wherein said rotary means includes a shaft, said shaft passing through said rotary finger and said clutch means, said rotor finger being fixedly attached to said shaft, said rotor finger being symmetric about the shaft and having two finger portions extending in opposite directions from said shaft.

4. An apparatus according to claim 3 wherein, said drawer means has a dead space located in the front thereof, the interior of said dead space not being accessible to persons on the exterior of said wall, and a free space where persons place the items being deposited, said clutch means does not rotate said rotary means until said free space is not accessible to persons on the exterior of said wall, said finger portions extending from the shaft to the backside of said dead space.

5. An apparatus according to claim 4 wherein, said clutch means includes a clutch gear which rotates around said shaft and a rack attached to said housing, said clutch gear engaging said rack as said drawer means is opened and closed, said rotary means including clutch dogs which interface with said clutch gear such that said rotary means rotates when said clutch gear engages said clutch dogs.

6. An apparatus according to claim 5 wherein said rotary means is designed to rotate one hundred and eighty degrees each time said drawer means is returned to its closed position.

7. An apparatus according to claim 6 wherein said clutch means further includes a clutch dog holder which is fixedly attached to said shaft, said clutch dogs being attached to said clutch dog holder.

8. An apparatus according to claim 7, wherein said clutch gear has a raised slanted surface that said clutch dogs interface and ride along as said drawer means is being opened.

9. An apparatus according to claim 4 wherein said rotary means includes more than one rotary finger spaced apart along the shaft, the bottom of the drawer means has spaces therein for said rotory fingers to pass through.

10. An apparatus according to claim 9 further comprising first means to prevent said drawer means from being closed once the drawer means has been opened a predetermined distance until said rotary means has completed a cycle.

11. An apparatus according to claim 10 wherein said first means includes:

a first guide bar slidably attached to said drawer means and having a pin extending therefrom, a ratchet, and a second guide bar fixedly attached to said housing, said ratchet being located above said second guide bar, wherein said pin follows a path along the top of ratchet and second guide bar as the drawer means is opened and closed, wherein said apparatus is designed and arranged such that when said pin is interfacing said ratchet, only the dead space of said drawer means is accessible to the exterior of the wall.

12. An apparatus according to claim 11 wherein said second guide bar has a notched tooth therein, said notched tooth being designed such that once said pin passes by said notched tooth as the drawer means is being closed, said pin can not pass by the notched tooth in the opposite direction and being located along said second guide bar such that when said pin is in said notched tooth, only said dead space is accessible to the exterior of said wall.

13. An apparatus according to claim 9 further comprising:

stationary fingers located adjacent said opening in said housing on the same side of the opening as the front of the apparatus, said stationary fingers being spaced to allow said rotor fingers to pass therethrough and having spikes angled downward in the direction of said opening in said housing.

14. An apparatus according to claim 9 further comprising a sprocket attached to said shaft and a pawl attached to said housing and having a head that engages said sprocket, said sprocket and pawl preventing said shaft from rotating in a given direction.

* * * * *